US010457895B2

(12) United States Patent
Kropf et al.

(10) Patent No.: US 10,457,895 B2
(45) Date of Patent: Oct. 29, 2019

(54) WASHING OR CLEANING AGENT FOR REDUCING MALODORS

(71) Applicants: Henkel AG & Co. KGaA, Duesseldorf (DE); Technische Universitaet Dresden Fachbereich Anorganische Chemie I, Dresden (DE)

(72) Inventors: Christian Kropf, Hilden (DE); Matthias Sunder, Duesseldorf (DE); Ursula Huchel, Cologne (DE); Peter Schmiedel, Duesseldorf (DE); Marc Weyhe, Krefeld (DE); Stefan Kaskel, Dresden (DE); Anja Guenther, Hamburg (DE); Steffen Hausdorf, Ringenhain (DE)

(73) Assignees: Henkel AG & Co. KGaA (DE); Technische Universität Dresden Fachbereich Anorganische Chemie I (DE)

( * ) Notice: Subject to any disclaimer, the term of this patent is extended or adjusted under 35 U.S.C. 154(b) by 0 days.

(21) Appl. No.: 15/851,379

(22) Filed: Dec. 21, 2017

(65) Prior Publication Data

US 2018/0119053 A1 May 3, 2018
US 2019/0211283 A9 Jul. 11, 2019

Related U.S. Application Data

(63) Continuation of application No. PCT/EP2016/064729, filed on Jun. 24, 2016.

(30) Foreign Application Priority Data

Jun. 26, 2015 (DE) ..... 10 2015 211 920

(51) Int. Cl.
*C11D 3/12* (2006.01)
*C11D 3/33* (2006.01)
(Continued)

(52) U.S. Cl.
CPC ..... *C11D 3/0068* (2013.01); *C11D 3/12* (2013.01); *C11D 3/168* (2013.01); *C11D 3/2082* (2013.01); *C11D 3/33* (2013.01)

(58) Field of Classification Search
CPC ..... C11D 3/0068; C11D 3/12; C11D 3/168; C11D 3/2082; C11D 3/33; B08B 3/04
See application file for complete search history.

(56) References Cited

U.S. PATENT DOCUMENTS 6,200,939 B1 3/2001 Maurer
2008/0206093 A1* 8/2008 Muller ..... A61K 8/27 422/5

FOREIGN PATENT DOCUMENTS

CN 103721682 A 4/2014
DE 102005023857 A1 11/2006
(Continued)

OTHER PUBLICATIONS

Database WPI, Week 198908, AN 1989-057294 XP-002761400, Thomson Scientific, London, GB, 1989.
(Continued)

*Primary Examiner* — Brian P Mruk
(74) *Attorney, Agent, or Firm* — Thomas G. Krivulka

(57) ABSTRACT

A washing or cleaning agent that has MOFs (metal organic frameworks) in order to reduce offensive odor, a method for reducing malodors, and the use of MOFs to reduce malodors.

7 Claims, 6 Drawing Sheets

(51) Int. Cl.

| | |
|---|---|
| ***C11D 3/00*** | (2006.01) |
| ***C11D 3/20*** | (2006.01) |
| ***C11D 3/16*** | (2006.01) |

(56) References Cited

FOREIGN PATENT DOCUMENTS

| | | | | | |
|---|---|---|---|---|---|
| EP | 3050618 | A1 | | 8/2016 | |
| JP | H018972 | A | | 1/1989 | |
| JP | 2014100655 | A | | 6/2014 | |
| WO | 9636373 | A1 | | 11/1996 | |
| WO | 2007035596 | A2 | | 3/2007 | |
| WO | WO 2007/035596 | | * | 3/2007 | ..... A61L 9/02 |

OTHER PUBLICATIONS

Hartmann, Martin et al. "Amino-functionalized basic catalysts with MIL-101 structure." Microporous and Mesoporous Materials, vol. 164, Jul. 2012, pp. 38-43, http://dx.doi.org/10.1016/j.micromeso.2012.06.044.

Kim, Se-Na et al. "Adsorption/catalytic properties of MIL-125 and NH2-MIL-125." Catalysis Today, vol. 204, Sep. 2012, pp. 85-93, http://dx.doi.org/10.1016/j.cattod.2012.08.014.

Volkringer, Christophe et al. "Synthesis, Single-Crystal X-ray Microdiffraction, and NMR Characterizations of the Giant Pore Metal-Organic Framework Aluminum Trimesate MIL-100." Chemistry of Materials, vol. 21, Nov. 2009, pp. 5695-5697, DOI:10.1021/cm901983a.

PCT International Search Report PCT/EP2016/064729 Completed: Sep. 2, 2016; dated Sep. 13, 2016 3 pages.

"Basolite C300, Copper benzene-1,3,5-tricarboxylate, Cu-BTC MOF HKUST-1." Sigma-Aldrich, Jan. 17, 2019, www.sigmaaldrich.com/catalog/product/aldrich/688614?lang=en&region=NL.

"Basolite A100, Aluminum terephthalate, MIL-53(Al)." Sigma-Aldrich, Jan. 17, 2019, www.sigmaaldrich.com/catalog/product/aldrich/688738?lang=en&region=NL.

"Basolite F300, Fe-BTC, Iron 1,3,5-benzenetricarboxylate." Sigma-Aldrich, Jan. 17, 2019, www.sigmaaldrich.com/catalog/product/aldrich/690872?lang=en&region=NL&cm_sp=Insite-_-prodRecCold_xviews-_-prodRecCold5-1.

"Iron Metal Organic Framework (Fe-(MOF-5), Purity: 99%, APS: 30-40UM)." NanoChemazone, Jan. 17, 2019, www.nanochemazone.com/product/iron-metal-organic-framework/.

EP Notification Under Article 94(3) EPC EP 16 731 925.0 dated Jan. 29, 2019 10 pages.

* cited by examiner

WASHING OR CLEANING AGENT FOR REDUCING MALODORS

FIELD OF THE INVENTION

The present invention relates to a washing or cleaning agent that has MOFs (metal organic frameworks) in order to reduce malodors, a method for reducing malodors, and the use of MOFs to reduce malodors.

BACKGROUND OF THE INVENTION

When textiles are worn and, in particular, physical activity causing perspiration is performed at the same time, textiles quickly lose their fresh smell after washing. Instead of the fresh smell, the odor of sweat arises, which is perceived as unpleasant by the wearer and by other persons.

Most body odors are perceived as unpleasant. The term "body odor" refers to all smellable human body scents emitted through the skin and, in a broader sense, from other body orifices, such as mouth odor, and to odors caused by excrements (urine, feces, flatus). The odor of sweat is typically the most clearly perceptible. Only the secretions of the apocrine sweat glands, which are located primarily in the axillae, have an odor. When the substances contained in axillary sweat, including endogenous fats and proteins, are decomposed by bacteria, odors are produced, which are perceived as unpleasant and often even repulsive.

Unsaturated or hydroxylated branched fatty acids, such as 3-methyl-2-hexanoic acid or 3-hydroxy-3-methylhexanoic acid, or sulfanyl alcohols, such as 3-methylsulfanylhexan-1-ol, are mainly responsible for body odor, more particularly for sweat odor. The body odor itself is influenced by different bacteria that constitute the skin flora. These bacteria form lipases, which decompose the fatty acids into small molecules, such as butanoic acid (butyric acid). Propanoic acid (propionic acid) is also a frequent component of sweat. It is produced when amino acids are decomposed by propionic acid bacteria.

In everyday life, other odors besides body odor are also perceived by humans as unpleasant. In the household, this applies to food remains that have dried onto dishes over a certain period of time, particularly fish or meat remains, the odor of floor soiling, or the odor of small animals that have died.

All of these odors are referred to as malodors in the present invention.

BRIEF SUMMARY OF THE INVENTION

In order to mask malodors, perfume oils are often added to washing or cleaning agents nowadays. Perfume oils ensure that malodors are masked or that malodors are perceptible to humans only after a certain time. However, allergic reactions to individual components of different formulations, including to perfume oils, are increasing nowadays. Therefore, there is also demand for formulations having the lowest possible content of perfume oils. In addition, it is desired that malodors are not masked but rather at least partially and preferably completely absorbed and therefore removed from the textile or from the surface, for example of dishes, or floors. Therefore, the problem addressed by the present invention is that of providing a washing or cleaning agent that is suitable for reducing malodors. At the same time, the visual impression of the treated surface should not be affected. For example, discoloration should not occur. Surprisingly, it has been found that MOFs (metal organic frameworks) are able to encapsulate malodors and thereby reduce the odor intensity of malodors or even completely avoid malodors.

The problem addressed by the present invention is therefore solved by a washing or cleaning agent that contains a metal organic framework (MOF). The addition of the MOF surprisingly leads to a reduction of malodors.

Metal organic frameworks (MOFs) are frameworks that consist of metal centers (atoms or clusters) and organic bridge molecules (linkers) as connecting elements between the metal centers. In general, MOFs can be two- or three-dimensional. In the present invention, the MOFs preferably have three-dimensional, porous networks. MOFs are coordination polymers. The pore size of MOFs can be varied by the selection of the linker size.

According to the present invention, the pores must be so large that they encapsulate molecules responsible for the malodor. However, the pores must not be so large that they encapsulate active components of the washing or cleaning agents, such as surfactants, and thereby reduce the effectiveness. MOFs that have at least two carboxylic acid groups (COOH groups) are especially preferred. Ligands of the type HOOC-A-COOH are preferred, wherein A is selected from Formula (I)

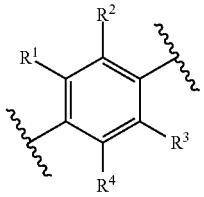

Formula (II)

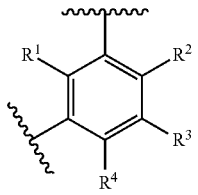

Formula (III)

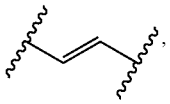

in which $R^1$, $R^2$, $R^3$, and $R^4$, independently of each other, are —H, —COOH, —$COO^-$, —OH, or —$NH_2$.

The ligand (organic bridge molecule, linker) of the MOF is preferably selected from the following general formula (IV), Formula (IV)

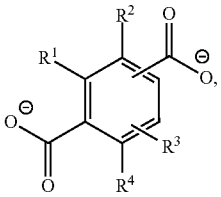

wherein $R^1$, $R^2$, $R^3$, and $R^4$ in general formula (IV) represent, independently of each other, —H, —COOH, —$COO^-$, —OH, or —$NH_2$.

The organic ligand of the MOF is especially preferably selected from 1,4-benzenedicarboxylic acid (BDC), 1,3,5-benzenetricarboxylic acid (BTC), 2-amino-1,4-benzenedicarboxylic acid (ABDC), fumaric acid, the mono, di-, or trivalent anions thereof, or mixtures thereof. According to the invention, an MOF can have several different organic ligands or only one organic ligand.

Surprisingly, it has been found that MOFs having appropriate ligands have a pore size that encapsulates malodors without influencing the effectiveness of the actual washing or cleaning agent.

The MOF preferably comprises aluminum, titanium, zirconium, iron, zinc, bismuth, or oxoclusters, hydroxoclusters, hydroxyoxoclusters, or mixtures thereof as a metal component (metal center). The MOF especially preferably comprises aluminum and/or iron.

Surprisingly, it has been found that metals other than those mentioned often lead to discoloration of textiles if textiles come in contact with the MOFs. Therefore, particularly in the case of washing agents used to wash textiles, it is preferred if aluminum and/or iron is used as a metal component. It has been found that copper in particular leads to discoloration of textiles and also to staining of a rough surface. Therefore, according to the invention, the MOF is preferably free of copper.

The washing or cleaning agents according to the invention are not colored by the MOF, or are only slightly colored by the MOF, so that the visual appearance of the textile or the surface is not impaired by the washing or cleaning agent according to the invention. The offensive odor is considerably reduced by the use of MOFs according to the invention in washing or cleaning agents.

The washing or cleaning agent according to the invention comprises MOFs preferably in amounts of 0.001 to 10 wt %, preferably 0.01 to 7 wt %, particularly 0.01 to 5 wt %, preferably 0.25 to 2.5 wt %, and more preferably 0.5 to 1 wt %. It has been found that a surplus of MOFs does not contribute to a reduction in malodors. However, a fraction of 0.001 wt % is necessary to achieve an effect. Especially good effects are achieved if MOFs are contained in a fraction of 0.01 wt % or more and particularly at least 0.25 wt %. Greater fractions of MOFs can achieve a better effect but also lead to higher costs accordingly. Good odor reduction or prevention can be achieved with a fraction of 10 wt %. A fraction of 1 wt % also leads to a considerable reduction in undesirable odors.

The MOFs are preferably incorporated into the washing or cleaning agent according to the invention as particles. The particle size is preferably 2 to 100 μm, particularly 5 to 70 μm, preferably 10 to 50 μm. If the MOFs are in the form of nanoparticles, there is a risk, especially in the case of washing agents, that only a small fraction is deposited on the substrate and therefore used, while the majority is rinsed away unused. If the particle size is greater than 100 μm, they are visible to the human eye. The MOFs are deposited on the surface treated with the washing or cleaning agent according to the invention. If, for example, a textile is cleaned with the washing or cleaning agent according to the invention, a stain caused by the deposited MOF particles would be visible on the surface if said particles have a size of 100 μm or greater. Therefore, the particle size is preferably less than 75 μm and particularly less than 50 μm.

It has been found that a specific surface area in the range of 100 to 4,000 $m^2/g$ is especially suitable for storing malodors without influencing the cleaning effectiveness of the washing or cleaning agents according to the invention. The specific surface area is determined by means of the single-point BET method according to DIN ISO 9277:2014. The specific surface area is preferably 500 to 3,200 $m^2/g$ and particularly 800 to 3,000 $m^2/g$.

The MOFs are used in particular in household cleaners, washing, cleaning, or pretreatment agents or refreshening sprays for textiles, laundry softening agents, cosmetic products, or air care products, such as room sprays or air fresheners. According to the invention, all of these products fall under the term "washing or cleaning agent." In the sense of the present invention, household cleaners are, for example, cleaning agents for cleaning hard surfaces, window cleaners, bathroom cleaners, toilet cleaners, or dish detergents (hand dishwashing detergents and automatic dishwasher detergents). In the sense of the present invention, cosmetic products are products for the cosmetic treatment of the skin and hair (skin treatment agents, hair treatment agents) such as hair shampoos, hair conditioning agents, hair masks, hair conditioners, agents for bleaching, dyeing, or shaping the hair, such as dyes, bleaching agents, tinting agents, color fixation agents, curling agents, or styling preparations such as hair setting lotions, mousses, or styling gels, shower gels, body creams, body lotions, face creams, or deodorants.

If the washing or cleaning agent according to the invention is a refreshening spray for textiles, said washing or cleaning agent comprises the at least one MOF in the form of a dispersion and preferably also at least one dispersing auxiliary agent and at least one solvent, particularly water. The at least one MOF can then be applied as an aerosol directly to particularly odor-critical areas of, for example, textiles, for example the armpit region of outer garments, or furniture comprising textiles, for example seat surfaces of sofas or armchairs. This allows the user to apply the MOF in a targeted manner in the locations in which use is desired.

If the washing or cleaning agent according to the invention is, for example, a solid, in particular powdery, washing agent, said washing or cleaning agent preferably contains the following components in addition to at least one perfume oil and one MOF:

- anion surfactants (anionic surfactants), such as preferably alkylbenzene sulfonate or alkyl sulfate, particularly in a fraction of 5 to 30 wt %; an anion surfactant or mixtures of different anion surfactants can be contained,
- nonionic surfactants, such as preferably fatty alcohol polyglycol ether, alkyl polyglucoside, or fatty acid glucamide, for example 0.5 to 15 wt % of one or more nonionic surfactants,
- one or more builders, such as zeolite, polycarboxylate, or sodium citrate, in amounts of in particular 0 to 70 wt %, advantageously 5 to 60 wt %, preferably 10 to 55 wt %, particularly 15 to 40 wt %,
- one or more alkaline compounds, such as sodium carbonate, particularly in amounts of 0 to 35 wt %, advantageously 1 to 30 wt %, preferably 2 to 25 wt %, particularly 5 to 20 wt %,
- one or more bleaching agents, such as sodium perborate or sodium percarbonate, in amounts of in particular 0 to 30 wt %, advantageously 5 to 25 wt %, preferably 10 to 20 wt %,
- optionally one or more corrosion inhibitors, such as sodium silicate, for example in amounts of 0 to 10 wt %, advantageously 1 to 6 wt %, preferably 2 to 5 wt %, particularly 3 to 4 wt %,
- one or more stabilizers, such as phosphonates, advantageously in a fraction of 0 to 1 wt %, one or more suds suppressors, such as soap, silicone oils, paraffins, advantageously in a fraction of 0 to 4 wt %, preferably 0.1 to 3 wt %, particularly 0.2 to 1 wt %, enzymes, such as proteases, amylases, cellulases, lipases, advantageously in a fraction of 0 to 2 wt %, preferably 0.2 to 1 wt %, particularly 0.3 to 0.8 wt %, graying inhibitors, such as carboxymethyl cellulose, advantageously in a fraction of 0 to 1 wt %, discoloration inhibitors, such as polyvinylpyrrolidone derivatives, advantageously in a fraction of 0 to 2 wt %, adjusters, such as sodium sulfate, advantageously in a fraction of 0 to 20 wt %, optical brighteners, such as stilbene derivative, biphenyl derivative, advantageously in a fraction of 0 to 0.4 wt %, particularly 0.1 to 0.3 wt %, optionally fragrances, such as perfume oils, optionally water, optionally soap, optionally bleach activators, optionally cellulose derivatives, optionally dirt repellents.

The specifications are in wt % and relate to the total weight of the washing agent.

In another, likewise preferred embodiment of the invention, the washing or cleaning agent is in liquid form, preferably in gel form. Preferred liquid washing or cleaning agents have a water content of, in particular, 3 to 95 wt %, preferably 8 to 80 wt %, and particularly 25 to 70 wt %, in relation to the total weight of the washing or cleaning agent. In the case of liquid concentrates, the water content can also be lower and can be 30 wt % or less, preferably 20 wt % or less, particularly 15 wt % or less. Here, too, the specifications in wt % relate to the total weight of the agent. In addition to water, the liquid agents can also have further non-aqueous solvents. A preferred liquid, particularly gel, washing agent according to the invention can preferably comprise components selected from the following in addition to the MOFs according to the invention:

anion surfactants (anionic surfactants), such as preferably alkylbenzene sulfonate, alkyl sulfate, particularly in a fraction of 5 to 40 wt %; an anion surfactant or mixtures of different anion surfactants can be contained, nonionic surfactants, such as preferably fatty alcohol polyglycol ether, alkyl polyglucoside, fatty acid glucamide, preferably in amounts of 0.5 to 25 wt % of one or more nonionic surfactants, one or more builders, such as zeolite, polycarboxylate, sodium citrate, advantageously in a fraction of 0 to 15 wt %, preferably 0.01 to 10 wt %, particularly 0.1 to 5 wt %, one or more suds suppressors, such as soap, silicone oils, paraffins, preferably in amounts of 0 to 10 wt %, advantageously 0.1 to 4 wt %, preferably 0.2 to 2 wt %, particularly 1 to 3 wt %, enzymes, such as proteases, amylases, cellulases, lipases, preferably in amounts of 0 to 3 wt %, advantageously 0.1 to 2 wt %, preferably 0.2 to 1 wt %, particularly 0.3 to 0.8 wt %, optical brighteners, such as stilbene derivative, biphenyl derivative, particularly in amounts of 0 to 1 wt %, advantageously 0.1 to 0.3 wt %, particularly 0.1 to 0.4 wt %, optionally fragrances, such as perfume oils, optionally stabilizers, water, optionally soap, particularly from 0 to 25 wt %, advantageously from 1 to 20 wt %, preferably from 2 to 15 wt %, especially from 5 to 10 wt %, optionally non-aqueous solvents, particularly alcohols, advantageously from 0 to 25 wt %, preferably from 1 to 20 wt %, particularly from 2 to 15 wt %.

The specifications in wt % relate to the total weight of the washing or cleaning agent.

In another, preferred embodiment, the washing or cleaning agent is a liquid softener, which can preferably contain further components selected from the following in addition to the at least one MOF according to the invention:

cationic surfactants, such as in particular esterquats, preferably in amounts of 5 to 30 wt %, cosurfactants, such as glycerol monostearate, stearic acid, fatty alcohols, fatty alcohol ethoxylates, particularly in amounts of 0 to 5 wt %, preferably 0.1 to 4 wt %, emulsifiers, such as fatty amine ethoxylates, particularly in amounts of 0 to 4 wt %, preferably 0.1 to 3 wt %, optionally fragrances, such as perfume oils, optionally dyes, preferably in the ppm range, optionally stabilizers, preferably in the ppm range, solvents, such as water in particular, in amounts of preferably 60 to 90 wt %.

The specifications in wt % relate to the total weight of the formulation, i.e., the softener. The specification in ppm relates to the weight (ppm by weight).

In another embodiment, the present invention relates to a method for reducing malodors that is wherein an MOF is brought in contact with a surface. The MOF is defined as it was defined above with respect to the washing or cleaning agent according to the invention. The washing or cleaning agent according to the invention is preferably a washing agent for textiles. In this case, it is preferred that the MOF is brought in contact with a textile during an automated or manual washing method, particularly during an automated washing method. However, the washing or cleaning agent according to the invention can also preferably be a cleaning agent for hard surfaces, such as a dish detergent, a floor cleaner, or an all-purpose cleaner. In this embodiment, it is preferred that the MOF is applied to the surface to be cleaned during an automated or manual washing method. An automated method can be, for example, the cleaning of dishes or glasses in a dishwasher.

In particular, the malodors are caused by the presence of acids, thiols, amines, aromatics, heteroaromatics, and/or alcohols. These malodors can be encapsulated in the MOFs according to the invention especially well so that malodors are reduced or even avoided, wherein acids, thiols, and amines are preferred.

In a further embodiment, the present invention relates to the use of MOFs to reduce malodors. According to the invention, the reduction occurs partially, preferably completely, so that malodors can be avoided. In particular, the reduction of malodors caused by the presence of acids, thiols, amines, aromatics, heteroaromatics, and/or alcohols is achieved. The MOF is especially preferably applied to textiles and/or hard surfaces by means of a washing method.

In the embodiment examples below, the present invention is illustrated by way of examples but is not restricted by the embodiment examples. Described embodiments can be combined with each other in any way according to the invention, without restriction.

Embodiment Examples

Example 1: Synthesis of Metal Organic Framework (MOF) Compounds According to the Invention Synthesis of $NH_2$-MIL-125(Ti)

On the basis of the following literature: S.-N. Kim et al., Catalysis Today 2013, 204, 85-93

A solution of 3 mmol of titanium isopropoxide ($Ti[OCH(CH_3)_2]_4$, Aldrich, 97%) and 6 mmol of 2-aminoterephthalic acid ($H_2BDC—NH_2$, Aldrich, 99%) in 50 mL of N,N-dimethyl formamide/methanol (1:1, v/v) was produced. Said solution was transferred to a 250-mL steel autoclave (DAB-3 from Berghof) having a PTFE insert. The autoclave was held at 150° C. for 16 h by means of a convection oven. After cool-down to room temperature, the yellow powder was filtered, washed twice with DMF, and then washed with ethanol.

The yield was 760 mg.

DETAILED DESCRIPTION OF THE INVENTION

Figure 1:
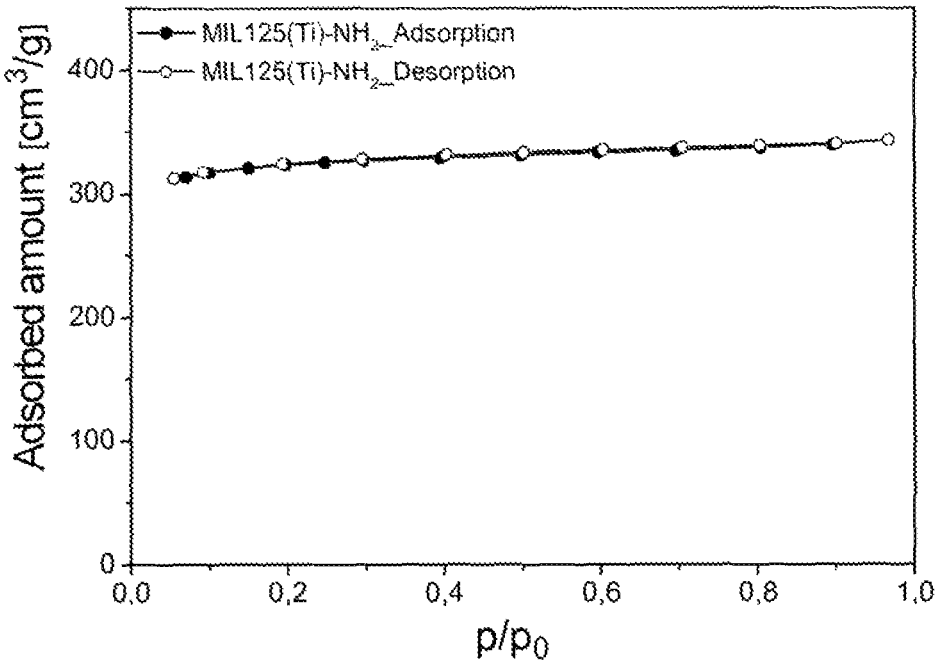
FIG. 1 illustrates a nitrogen adsorption isotherm.

After the activation of a sample of the obtained material at 120° C. and $10^{-3}$ mbar, a nitrogen adsorption isotherm (FIG. 1) was recorded at 77 K. At $p/p_0$=0.3, a specific surface area of 1,134 $m^2/g$ could be determined from said isotherm by means of the single-point BET method (DIN ISO 9277:2014).

Figure 2:
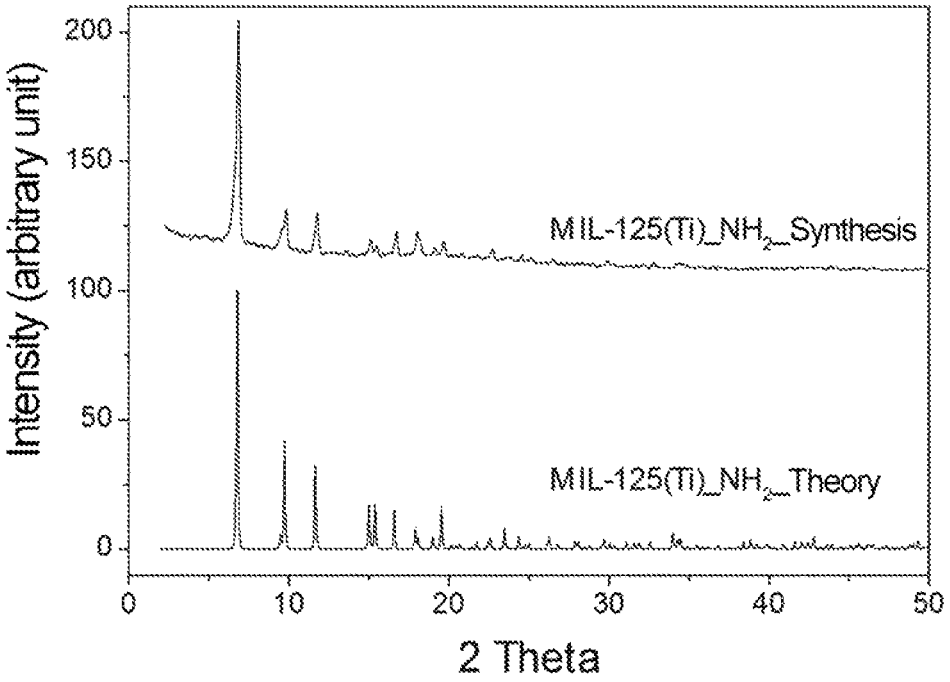
FIG. 2 is an x-ray powder diffractogram showing the reflections of $NH_2$-MIL-125(Ti)

The x-ray powder diffractogram (FIG. 2) of the sample shows the reflections of $NH_2$-MIL-125(Ti) at the expected positions.

Synthesis of MIL-100(Al)

On the basis of the following literature: Volkrieger et al., Chem. Mater. 2009, 21, 5695-5697.

A mixture of 11.2 mmol of $Al(NO_3)_3.9\ H_2O$ (Grüssing, 99%), 9.1 mmol of trimesic acid trimethyl ester (self-synthesized), 14 mL of 1 M $HNO_3$, and 50.4 mL of deionized $H_2O$ was transferred to a 250-mL steel autoclave (DAB-3 from Berghof) having a PTFE insert. The autoclave was heated at 210° C. for 3 h 30 min in a drying oven.

After cool-down to room temperature, the product was separated from the yellow mother liquor by means of a laboratory centrifuge at 4,000 rpm. To wash the precipitate, the precipitate was resuspended in 50 mL of ethanol and centrifuged again under the same conditions and the washing solution was discarded. This washing process was then repeated two more times. After the solid thus obtained was dried at room temperature at finally $10^{-3}$ mbar for 16 h, 6.3 g of raw product were obtained.

Said raw product contained contaminants encapsulated in the pores, and said contaminants reduce the porosity. To remove said contaminants, the product was resuspended in 400 mL of N,N-dimethyl formamide and the suspension was held at 150° C. for 4 h in a 1-liter Schott flask inside a drying oven. Then the solid was centrifuged off, put into 50 mL of deionized water, and centrifuged again and the washing water was discarded.

The product thus obtained was finally cleaned by means of a Soxhlet apparatus by using 0.5 L of deionized water for 12 h and then desolvated at 220° C. and $10^{-3}$ mbar for 4 h.

In this way, 2.0 g of a white, light solid were obtained.

Figure 3:
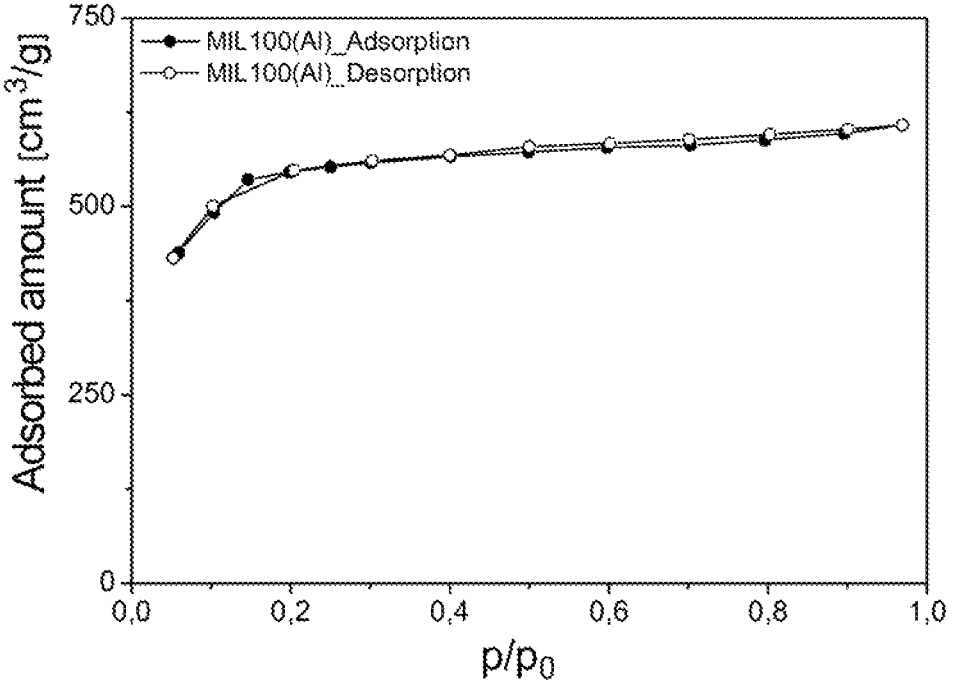
FIG. 3 shows a nitrogen adsorption isotherm without further activation of the material.

Without further activation of the material, a nitrogen adsorption isotherm (FIG. 3) was recorded at 77 K. At $p/p_0$=0.3, a specific surface area of 1,637 $m^2/g$ could be determined from said isotherm by means of the single-point BET method (DIN ISO 9277:2014).

Figure 4:
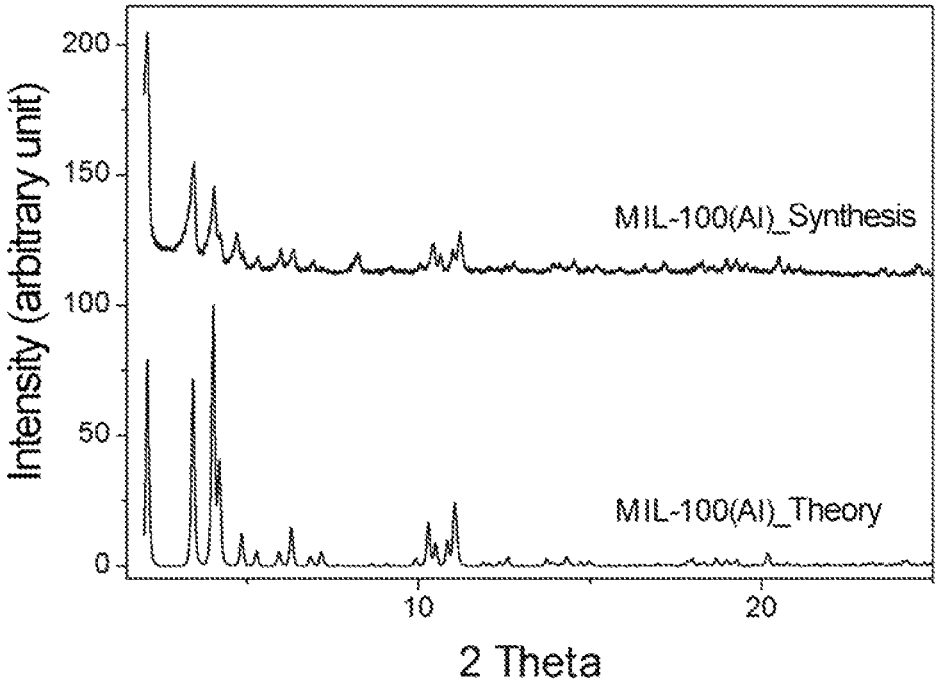
FIG. 4 is an x-ray powder diffractogram showing the reflections of MIL-100(Al)

The x-ray powder diffractogram (FIG. 4) of the sample shows the reflections of MIL-100(Al) at the expected positions.

Synthesis of $NH_2$-MIL-101(Al)

On the basis of the following literature: M. Hartmann, M. Fischer, Microporous Mesoporous Mater. 2012, 164, 38-43.

30 mmol of 2-aminoterephthalic acid (Aldrich, 99%) were dissolved in 1.1 L of N,N-dimethyl formamide and heated in a 2-liter three-neck flask to 110° C. with reflux.

60 mmol of $AlCl_3.6\ H_2O$ (Fluka, 99%) were divided into seven portions of equal size. Each portion was dissolved in 14 mL of N,N-dimethyl formamide while heating was performed and was stored sealed for further use.

At a time interval of 15 min and while magnetic stirring was performed, the individual aluminum chloride solutions were added to the hot solution of 2-aminoterephthalic acid. After the last addition, the solution was held at 110° C. for 3 h with stirring and then for 16 h without stirring.

After cool-down to room temperature, the formulation was filtered by means of a G4 fit and washed there with 1×200 mL of N,N-dimethyl formamide and with 5×200 mL of ethanol.

The product thus obtained was extracted by means of a Soxhlet apparatus by using 1 L of ethanol for 12 h and then dried at 90° C. for 24 h in a drying oven.

6.95 g of product were obtained.

Figure 5:
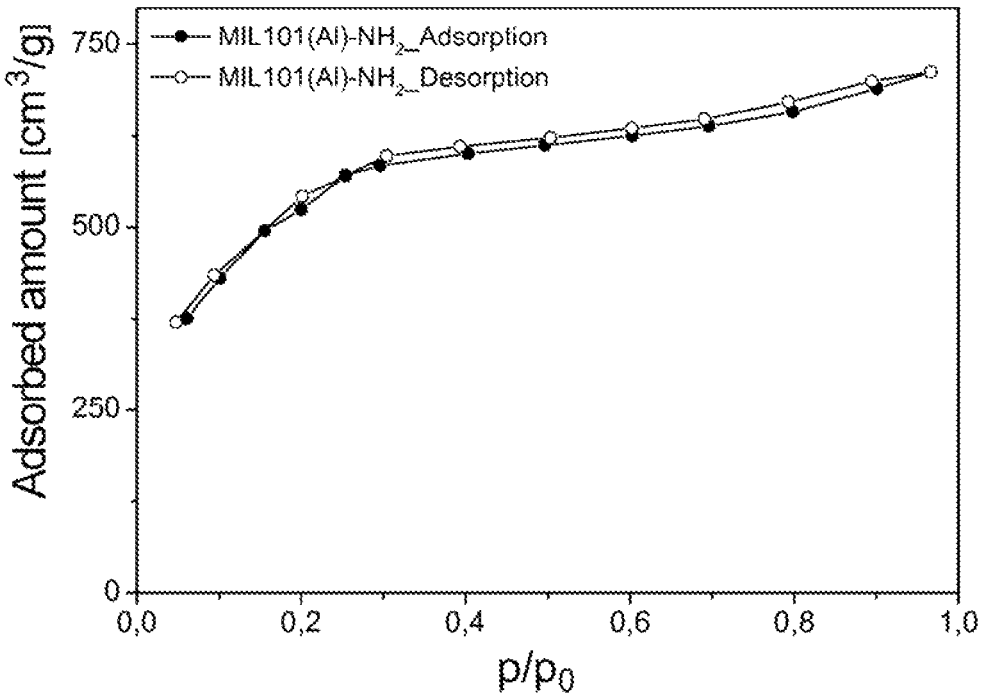
FIG. 5 is a nitrogen adsorption isotherm after activation of a sample of the obtained material.

After the activation of a sample of the obtained material at 120° C. and $10^{-3}$ mbar, a nitrogen adsorption isotherm (FIG. 5) was recorded at 77 K. At $p/p_0$=0.3, a specific surface area of 2,839 $m^2/g$ could be determined from said isotherm by means of the single-point BET method (DIN ISO 9277:2014).

Figure 6:
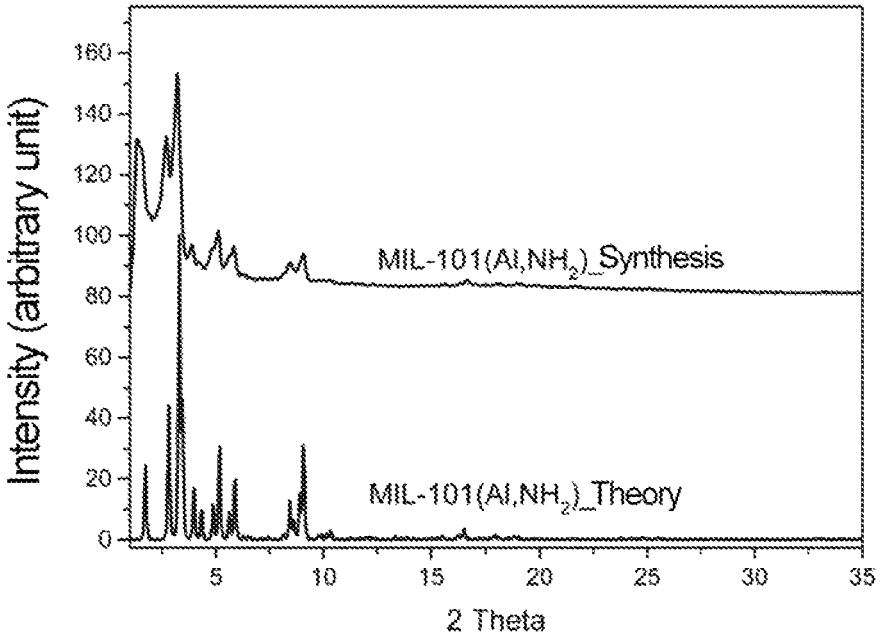
FIG. 6 is an x-ray powder diffractogram showing the reflections of $NH_2$-MIL-101(Al).

The x-ray powder diffractogram (FIG. 6) of the sample shows the reflections of $NH_2$-MIL-101(Al) at the expected positions.

Example 2: Odor Test

The performance with regard to reduction of offensive odor was determined as follows. The MOF powders were suspended in a solvent (aqueous or non-aqueous, such as ethanol, deionized water, or washing-agent solution (produced by dissolving 4 g of a liquid washing agent in 1 L of water of 16° dH)) by means of an ultrasonic bath. Nonwovens (various materials, such as polypropylene (PP) or viscose) were uniformly wetted with suspension on a permeable base. The filter function of the nonwoven material causes immobilization of the MOF solid particles. A (2 cm×2 cm) nonwoven equipped with the particular MOF was placed in a screw-top glass jar of defined size. A defined amount of a sweat offensive-odor mixture was introduced into said jar. The jar was immediately closed. After a holding time of 5 min, the jar was opened and the odor intensity was determined olfactorily (scale of 0-10; 0=no offensive odor, 10=strong offensive odor). In addition to compounds according to the invention, comparison compounds and untreated nonwoven as a standard were also examined. Each examination was performed twice by two persons independently of each other.

The sweat offensive-odor mixture contained the following components:

20 wt % octanoic acid
20 wt % nonanoic acid
20 wt % 3-methylbutanoic acid
20 wt % 2-ethyl-2-hexenoic acid
20 wt % 3-mercapto-1-hexanol The following table summarizes the results as mean values of a double determination. The MOF was applied to the nonwoven from ethanolic suspension. The nonwovens were then dried at 120° C. The untreated PP nonwoven (standard) has an odor intensity of 8.5.

| MOF sample on PP nonwoven MOF type/ metal/linker | Odor intensity (nonwoven loading 0.05 mg/cm$^2$) | Odor intensity (nonwoven loading 0.25 mg/cm$^2$) | Color impression of nonwoven |
|---|---|---|---|
| MIL-100/Al/BTC | 3 | 0 | Acceptable |
| MIL-101/Fe/BDC | 4 | 2 | Acceptable |
| MIL-101/Fe/ABDC | 5 | 0 | Acceptable |
| MIL-125/Ti/BDC | 7 | 6 | Acceptable |
| MIL-125/Ti/ABDC | 4 | 1 | Acceptable |
| MIL-101/Al/ABDC | 2 | 0 | Acceptable |
| Al fumarate/Al/ fumaric acid | 5.5 | 2 | Acceptable |
| CuBTC/Cu/BTC (not according to the invention) | 6 | 2 | Unacceptable (blue) |

BTC: 1,3,5-benzenetricarboxylic acid
BDC: 1,4-benzenedicarboxylic acid
ABDC: 2-amino-1,4-benzenedicarboxylic acid The following table comprises the results as mean values of a double determination. The MOF was applied to the nonwoven from suspension in deionized water (WT) or from the washing-agent-solution-based suspension (WASS). The nonwovens were then dried at 60° C. for 1 h.

| MOF sample on viscose nonwoven MOF type/metal/ linker | Odor intensity, untreated viscose nonwoven | Odor intensity (nonwoven loading 0.05 mg/cm$^2$) | Odor intensity (nonwoven loading 0.25 mg/cm$^2$) | Color impression of nonwoven |
|---|---|---|---|---|
| MIL-100/Al/BTC via WT | 8 | 6 | 4 | Acceptable |
| MIL-100/Al/BTC via WASS | 8 | 2 | 1 | Acceptable |
| MIL-101/Al/ABDC via WT | 8 | 6 | 5 | Acceptable |
| MIL-101/Al/ABDC via WASS | 8 | 5 | 4 | Acceptable |
| MIL-53/Al/ABDC via WT | 7 | 6 | 6 | Acceptable |
| MIL-53/Al/ABDC via WASS | 7 | 4 | 4 | Acceptable |

BTC: 1,3,5-benzenetricarboxylic acid
BDC: 1,4-benzenedicarboxylic acid
ABDC: 2-amino-1,4-benzenedicarboxylic acid Surprisingly, it has been found that MOFs according to the invention lead to a reduction in malodors. In addition, the color impression of the treated surface, for example of a textile, is not affected.

Example 3: Absorption

A softener having the following composition was produced:

| Ingredient | wt % active substance |
|---|---|
| Dem. water | 90.1669 |
| MgCl*6 $H_2O$ | 0.0595 |
| Stepantex CHT 90 | 4.75 |
| DC AC 8066 | 0.0190 |
| Parmetol D11 | 0.0046 |
| MIL-100(Al) | 5.00 |

Then the absorption behavior of the MOF according to the invention on textiles was determined, on the basis of the softener specified above, in comparison with an aqueous solution consisting of the same MOF as in the softener specified above and water.

For this purpose, a 46-g cotton terry-cloth woven fabric was rinsed with 225 mL of liquid, containing 0.33 g of softener (for composition, see table above), in a launderometer for 30 minutes at 20° C. and then spin dried for 60 seconds (Thomas spin dryer, model 772 NEK286). After the drying, the aluminum content was determined.

As a comparison, the same amount of the same MOF was applied to the terry-cloth woven fabric in a forced manner by dripping application and subsequent drying.

To determine the adsorption behavior of the MOF according to the invention, the aluminum content was determined by means of ICP-OES (atomic emission spectroscopy) on the treated textiles.

| | Amount of aluminum (mg (Al)/kg (textile)) |
|---|---|
| Forced-application comparison example | 89 |
| Softener containing MIL-100(Al) | 74 |

One can see that the MOF according to the invention nearly completely adsorbs in the presence of softener.

Example 4: Odor Test

To evaluate the reduction of malodors on textiles in the case of treatment from a softener liquid, the following was performed.

Cotton terry cloth, polyester terry cloth, and Coroness cotton woven fabric pieces were each washed 10 times with a liquid, containing 1.5 g/L of the softener from example 3 (for composition, see table above in example 3) or 1.5 g/L of a softener identical to the softener from example 3 but without the MOF according to the invention, in a launderometer for 30 minutes at 20° C. and then spin dried for 60 seconds (Thomas spin dryer, model 772 NEK286) and dried in air.

The treated textile pieces were then subjected to an odor test, wherein a very strong offensive odor was assessed as 10 and a very weak offensive odor was assessed as 1. The aluminum content was also determined by means of ICP-OES. As a further comparison, the untreated textile was examined.

| Cotton terry cloth | Amount of aluminum (mg/kg) | Intensity of offensive odor (1-10) |
|---|---|---|
| Softener with MOF | 510 | 2 |
| Softener without MOF | 10 | 4 |
| Untreated | 5 | 7 |

| Polyester terry cloth | Amount of aluminum (mg/kg) | Intensity of offensive odor (1-10) |
|---|---|---|
| Softener with MOF | 440 | 5 |
| Softener without MOF | 6 | 7 |
| Untreated | 2 | 9 |

| Coroness cotton woven fabric | Amount of aluminum (mg/kg) | Intensity of offensive odor (1-10) |
|---|---|---|
| Softener with MOF | 570 | 4 |
| Softener without MOF | 8 | 5 |
| Untreated | 4 | 8 |

What is claimed is:

1. A washing or cleaning agent, wherein said washing or cleaning agent contains a metal organic framework (MOF) comprising organic ligands having the general formula (IV), Formula (IV)

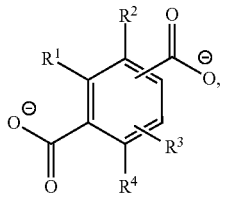

wherein $R^1$ to $R^4$ in general formula (IV) represent, independently of each other, —H, —COOH, —$COO^-$, —OH, or —$NH_2$;

wherein the washing or cleaning agent further comprises:

a) 5 to 40 wt % anionic surfactants selected from the group consisting of alkylbenzene sulfonates, alkyl sulfates and mixtures thereof, b) 0.5 to 25 wt % nonionic surfactants selected from the group consisting of fatty alcohol polyglycol ethers, alkyl polyglucosides, fatty acid glucamides and mixtures thereof;

and wherein the metal organic framework is free of copper.

2. The washing or cleaning agent according to claim 1, wherein the organic ligand of the metal organic framework is obtained from 1,4-benzenedicarboxylic acid, 1,3,5-benzenetricarboxylic acid, 2-amino-1,4-benzenedicarboxylic acid, fumaric acid, mono-, di-, or trivalent anions thereof, or mixtures thereof.

3. The washing or cleaning agent according to claim 1, wherein the metal organic framework comprises aluminum, titanium, zirconium, iron, zinc, bismuth, or oxoclusters, hydroxoclusters, hydroxyoxoclusters, or mixtures thereof as a metal component.

4. The washing or cleaning agent according to claim 1, comprising 0.001 to 10 wt % of the metal organic framework.

5. A method for reducing malodors, wherein a washing or cleaning agent, according to claim 1 is brought in contact with a surface.

6. The method for reducing malodors according to claim 5, wherein the metal organic framework is applied to a textile or a hard surface during an automated method.

7. The method for reducing malodors according to claim 5, wherein the malodor is caused by the presence of acids, thiols, amines, (hetero)aromatics, and/or alcohols.

* * * * *